United States Patent [19]

Pearson

[11] Patent Number: 4,523,718

[45] Date of Patent: Jun. 18, 1985

[54] SHOWERHEAD

[76] Inventor: H. Alton Pearson, 125 Cedarbrook Rd., Ardmore, Pa. 19003

[21] Appl. No.: 126,407

[22] Filed: Mar. 3, 1980

[51] Int. Cl.[3] ..... B05B 1/18; B05B 7/00

[52] U.S. Cl. ..... 239/106; 239/428.5; 239/499

[58] Field of Search ..... 239/428.5, 453, 459, 239/499, 500, 570, 398, 106, 107

[56] References Cited

U.S. PATENT DOCUMENTS

| | | | |
|---|---|---|---|
| 2,858,120 | 10/1958 | Goodrie | 239/428.5 |
| 2,990,123 | 6/1961 | Hyde | 239/459 X |
| 3,322,352 | 5/1967 | Alcantara | 239/428.5 |
| 3,358,934 | 12/1967 | Moen | 239/428.5 |
| 3,831,860 | 8/1974 | Gullaksen et al | 239/500 |
| 3,999,714 | 12/1976 | Lang | 239/570 |
| 4,013,230 | 3/1977 | Gondek | 239/499 |
| 4,139,022 | 2/1979 | Marmon | 239/570 |
| 4,145,004 | 3/1979 | Krizik | 239/499 |

*Primary Examiner*—Andres Kashnikow
*Attorney, Agent, or Firm*—Paul & Paul

[57] ABSTRACT

A showerhead of the type including an inlet end, an outlet end, and a bore defining a passage between the two. Diffusing stages are incorporated within the bore. These diffusing stages consist of a plurality of orifices arranged with their centers spaced at regular intervals around a circle of predetermined diameter. A diffusing washer is rigidly mounted to the diffusing stage nearest the outlet end to deflect the water stream from a substantially parallel path to an inclined path which intercepts the interior wall of the outlet end. Aeration holes extending substantially perpendicular to the flow of water allows air to be drawn into the water stream producing turbulence and diffusion of the water stream. In one embodiment the last diffusing stage is movably mounted within said bore in such a manner that if its orifices become clogged it can move axially downstream to allow the water to flow around the stage and exit the showerhead.

1 Claim, 3 Drawing Figures

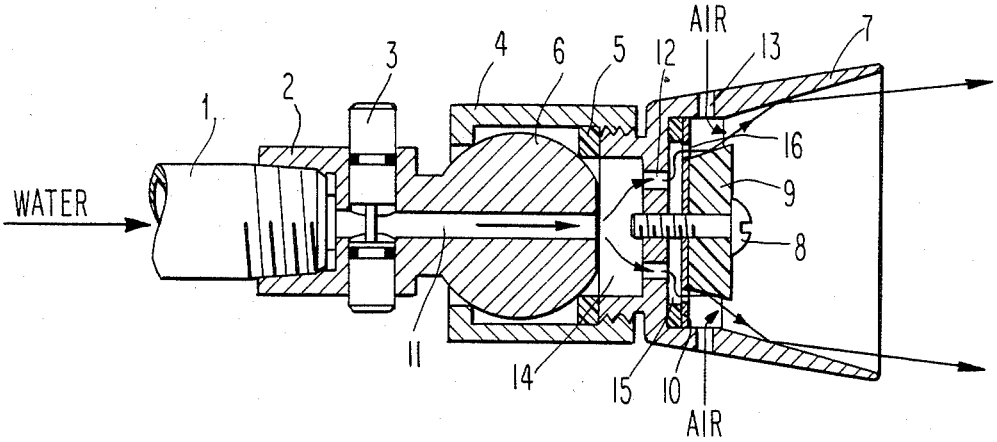
Fig. 1
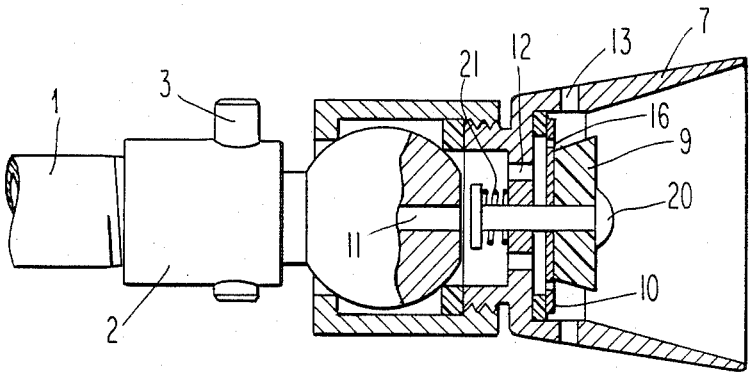
Fig. 2
Fig. 3
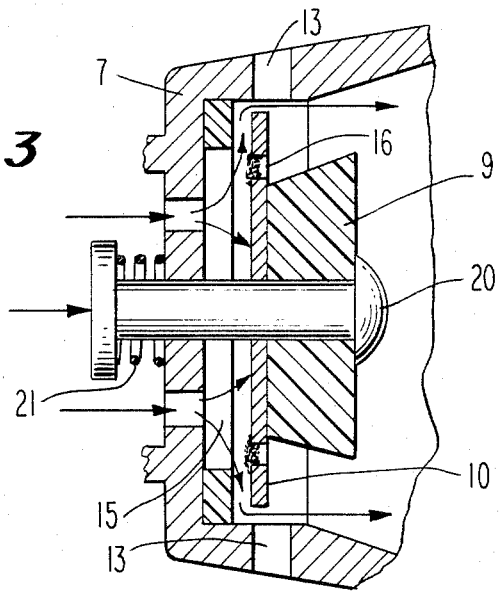

SHOWERHEAD

This invention relates to showerheads.

It is a principle object of the present invention to provide a simple showerhead that conserves water. Other objects include providing a showerhead that aerates and diffuses the water stream in such a manner that a small volume of water functions as effectively as the larger stream of water used in earlier showerheads. It is a further object of this invention to provide a showerhead which, if clogged by debris, will automatically adapt to this clogged condition by opening a secondary passage for water flow.

Other objects, features and advantages will appear from the following detailed description of the invention, taken together with the attached drawing in which:

FIGS. 1 and 2 are plan views, partially in section, of a showerhead embodying the invention;

FIG. 3 is a sectional view of the diffusing stage and diffusing washer of the showerhead.

Referring now to FIG. 1, I will describe the principal features of one configuration of this invention.

Water under pressure is provided to the showerhead through inlet pipe 1 which is threaded into coupling 2. Water enters the showerhead through the passageway 11, past the throttle valve 3. Throttle valve 3, when in the position shown, is open. When this valve is depressed to the closed position (not shown) it interrupts the flow of water to the showerhead. It should be understood that the volume and temperature of water employed in this showerhead is controlled by the usual faucets or the like before the water enters the showerhead. Water flowing through passageway 11 enters chamber 14 as shown. Passageway 11 is a cavity within ball-shaped member 6, said member being enclosed by the showerhead body 4. A gasket 5 prevents seepage of water from chamber 14 and allows the showerhead body 4 to be moved within limits allowing adjustment of the direction of the flow of water from the showerhead.

The water exits chamber 14 through a number of orifices 12. These orifices, 12, 14 arranged in a circle with the axis of the orifice parallel to the center-line axis of the showerhead assembly. These orifices 12, located as shown in the upstream end of outlet end 7 of the showerhead assembly, comprise what will be referred to as the first diffusing stage of the showerhead assembly. The size, number and arrangement of the orifices comprising this first stage are a matter of design choice.

Water exits the first diffusing stage through orifices 12 and enters second chamber 15. Water then exits chamber 15 as shown through a second diffusing stage comprising a similar series of orifices arranged in a circle on disc 10 in such a manner that water is allowed to pass through these orifices essentially parallel to the axis of the showerhead assembly as shown. The number, arrangement, and size of orifices 16 in the second diffusing stage is also a matter of design choice.

When the water exits the downstream face of the second diffusing stage it impacts the peripheral sloping face of diffusing washer 9 in the manner shown such that the water is deflected against the interior wall of outlet end 7.

As illustrated, circular diffusing washer 9 has an outwardly sloping perimeter which intercepts the flow of water from orifices 16. The degree of slope of this outer perimeter of diffusing washer 9 is selected to deflect the water stream through a fairly small angle. This deflection causes the water stream to be turbulent as it departs the surface of diffusing washer 9. This action, coupled with the aeration of the water through aeration ports 13, to be described below, results in a fine water stream exiting the showerhead which nevertheless has an effect similar to showerheads using considerably more water.

As water at high velocity passes through orifices 16 onto diffuser washer 9 and then continues downstream to exit the outlet end of the showerhead a reduced pressure is created inside the showerhead. Accordingly, air enters the showerhead through aeration ports 13 and mixes with the water stream as shown. This aeration process, coupled with the effect of the diffusion washer previously described, produces a very fine spray of water.

The amount of water that flows through the showerhead is controlled principally by the pressure of the water and the area of the orifices employed in the first and second diffusing stages. In a preferred embodiment of this invention these orifice sizes are chosen such that the flow of water through the showerhead is reduced to approximately 1 to 1½ gallons per minute which saves up to 75% on water usage as compared to a standard showerhead. This decrease in water usage could not be achieved without substantial loss of shower effect but for the novel utilization of aeration of the water stream through aeration holes 13. This aeration contributes to the water savings by drawing in air and causing an internal turbulence that tends to add air to the water flow thereby giving the same shower effect as though two to three times the amount of water being used.

As shown in FIG. 1 diffusing washer 9 and the second diffusing stage disc 10 are held in place by threaded bolt 8. This bolt can easily be removed to allow cleaning of orifices 12 and 16 should they become clogged with debris. FIG. 2 illustrates a variation of the showerhead invention wherein diffusing washer 9 and second diffusing stage 10 are movably mounted within the outlet end 7 of the showerhead assembly on rivet 20. Spring 21 mounted concentrically around rivet 20, as shown, normally urges the upstream face of second diffusing stage 10 against the inner face of nozzle outlet assembly 7 in such a manner that water cannot flow around the second diffuser stage. As shown in FIG. 3, the orifices of the second diffuser stage 16 may become clogged with debris. Should this occur water pressure builds up in small chamber 16 and displaces the diffusing stage disc 10 downstream opening a passage as shown for the water to flow. Thus the showerhead of this invention is usable even if one diffusing stage becomes clogged. The engineering parameters of spring 21, such as spring constant, spring length, etc., are selected in such a manner that movement of disc 10 occurs before the source pressure of the inlet water supply is reached, thus this movement acts as a safety feature as well as allowing the shower assembly to be operative even when clogged. Of course, water exiting around the second diffuser stage is not as finally atomized as that flowing through the stage, although aeration still occurs.

In the preferred embodiment the major components of the showerhead such as the throttle pin, coupling diffuser disc and outlet end are constructed of solid brass. Other components such as threaded bolt 8 are made of stainless steel and the diffuser washer 9 may be made of nylon or plastic. These selections are also a matter of design choice.

Other embodiments will be within the scope of the following claims.

What is claimed is:

1. A showerhead for reducing water usage while providing effective shower effect comprising a body having an inlet end adapted to be connected to a source of water under pressure, a water outlet end spaced apart from said inlet end, and a bore defining a passage extending between said inlet and outlet ends, comprising:

at least one diffusing stage within said bore comprising a disc having a plurality of orifices essentially parallel to the direction of water flow;

a diffusing washer within said bore fixedly attached to the downstream face of said disc to deflect the water from a path essentially parallel to the axis of said bore to a path which intercepts the interior wall of said water outlet before exiting the showerhead, wherein said diffusing washer and disc are movably mounted within said bore allowing said disc and washer to move axially downstream creating an alternate path for water flow around said disc if the orifices of said disc are clogged.

* * * * *